US007044833B2

(12) United States Patent
Yun et al.

(10) Patent No.: US 7,044,833 B2
(45) Date of Patent: May 16, 2006

(54) APPARATUS FOR TRANSPORTING AND POLISHING WAFERS

(75) Inventors: Hyun-Joo Yun, Gyeonggi-do (KR); Sang-Seon Lee, Gyeonggi-do (KR); Jong-Bok Kim, Gyeonggi-do (KR); Kwang-Hee Lee, Gyeonggi-do (KR); Min-Su Kim, Seoul (KR); Hyun-Sung Lee, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/004,612

(22) Filed: Dec. 2, 2004

(65) Prior Publication Data

US 2005/0164604 A1 Jul. 28, 2005

(30) Foreign Application Priority Data

Dec. 3, 2003 (KR) ..... 10-2003-0087141

(51) Int. Cl.
*B24B 49/00* (2006.01)

(52) U.S. Cl. ..... 451/6; 451/285

(58) Field of Classification Search ..... 451/41, 451/5, 6, 8, 285–289, 397, 398
See application file for complete search history.

(56) References Cited

U.S. PATENT DOCUMENTS 6,520,839 B1 * 2/2003 Gonzalez-Martin et al. .. 451/41
6,629,883 B1 * 10/2003 Katsuoka et al. ..... 451/332
6,672,820 B1 * 1/2004 Hanson et al. ..... 414/222.06
6,878,044 B1 * 4/2005 Sakurai et al. ..... 451/67
6,916,231 B1 * 7/2005 Wakabayashi ..... 451/66

FOREIGN PATENT DOCUMENTS

| | | |
|---|---|---|
| JP | 2003-133271 | 9/2003 |
| KR | 20-0247999 | 9/2001 |
| KR | 10-0353916 | 9/2002 |
| KR | 2003-0031790 | 4/2003 |

OTHER PUBLICATIONS

English language abstract of Korean Publication No. 2003-0031790.
English language abstract of Korean Publication No. 20-0247999.
English language abstract of Korean Publication No. 10-0353916.
English language abstract of Japanese Publication No. 2003-133271.

* cited by examiner

*Primary Examiner*—Dung Van Nguyen
(74) *Attorney, Agent, or Firm*—Marger Jonson & McCollom, P.C.

(57) ABSTRACT

The present invention discloses an apparatus for transporting wafers. The apparatus includes a tray having a sloped portion on which a wafer having a sidewall can be mounted, a plurality of guides that disposed about the tray, and a plurality of sensors for detecting the position of the sidewall of the wafer with respect to the tray on which it is mounted by sensing the position of the sidewall. The present invention also discloses an apparatus for polishing wafers having the apparatus for transporting wafers comprising the circular tray and a plurality of guides and a plurality of sensors above-mentioned.

20 Claims, 4 Drawing Sheets

APPARATUS FOR TRANSPORTING AND POLISHING WAFERS

CROSS-REFERENCE TO RELATED APPLICATIONS

This U.S. non-provisional patent application claims priority under 35 U.S.C. § 119 of Korean Patent Application 2003-87141 filed on Dec. 3, 2003, the entire contents of which are hereby incorporated by reference.

BACKGROUND OF THE INVENTION

The present invention relates to a wafer transfer and a wafer polishing apparatus, and more specially, to a wafer transfer and a polishing apparatus capable of sensing the existence of the wafer as well as the proper loading of the wafer.

Recent rapid progress in semiconductor device integration demands smaller and smaller wiring patterns or interconnections and also narrower spaces between interconnections which connect active areas. One process available for forming such interconnections is photolithography. A photolithographic process requires that surfaces on which pattern images are to be focused by a stepper should be as flat as possible because depth of focus of an optical system is relatively small. It is therefore necessary to make surfaces of semiconductor wafers flat for photolithography.

One customary way of planarizing the surface of the semiconductor wafer is to polish the semiconductor wafer by a CMP (Chemical Mechanical Polishing) process. The polishing apparatus to planarize the surfaces of the semiconductor wafers generally comprises a polishing table to which a polishing pad is attached, and top rings are employed to hold the semiconductor wafers onto the polishing table. In this polishing apparatus, semiconductor wafers are mounted on respective top rings, and then all the semiconductor wafers held by the top rings are simultaneously pressed down against the polishing pad on the polishing table, and then the wafers are polished.

An exemplary of polishing apparatus is disclosed in the U.S. Pat. No. 6,629,883 "Polishing apparatus" by Katsuoka, et al. According to the patent above-mentioned, the polishing apparatus has a transfer for transporting the semiconductor wafers from the top rings or to the top rings.

Referring to FIG. 10 in the U.S. Pat. No. 6,629,883 above-mentioned, wafer detecting sensors are provided at positioned spaced from the transfer. Each sensor is a photosensor comprising a light-emitting element and a light-receiving element. These sensors detect whether the semiconductor wafers are chucked on the transfer or not.

However, because the light-emitting and light-receiving elements are installed at a tilted position with respect to the surface of the semiconductor wafer, these sensors have a difficulty for sensing proper positioning of the wafer. Improper wafer positioning may lead to wafer damage in the subsequent processing or even breakdown of the semiconductor manufacturing apparatus, e.g. polishing apparatus.

SUMMARY OF THE INVENTION

In one embodiment, an apparatus includes a tray having a sloped portion on which a wafer having a sidewall can be mounted, a plurality of guides that disposed about the tray, and a plurality of sensors for detecting the position of the sidewall of the wafer with respect to the tray on which it is mounted by sensing the position of the sidewall.

The accompanying drawings are included to provide a further understanding of the invention, and are incorporated in and constitute a part of this specification. The drawings illustrate example embodiments of the present invention and, together with the description, serve to explain principles of the present invention.

DETAILED DESCRIPTION OF PREFERRED EMBODIMENTS

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the invention to those skilled in the art. Like numerals refer to like elements throughout the specification. Hereinafter, an exemplary embodiment of the present invention will be described in conjunction with the accompanying drawings.

Figure 1:
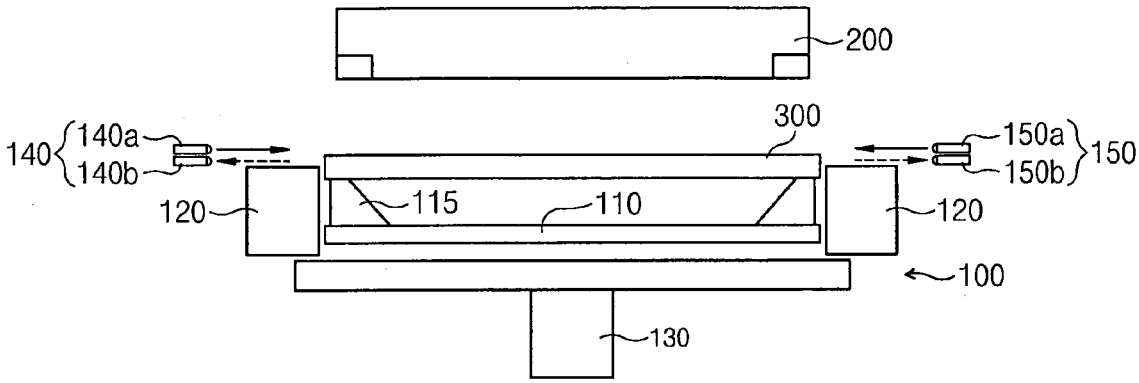
FIG. 1 illustrates a cross-sectional view of a wafer transfer according to an exemplary embodiment of the present invention.
Figure 2:
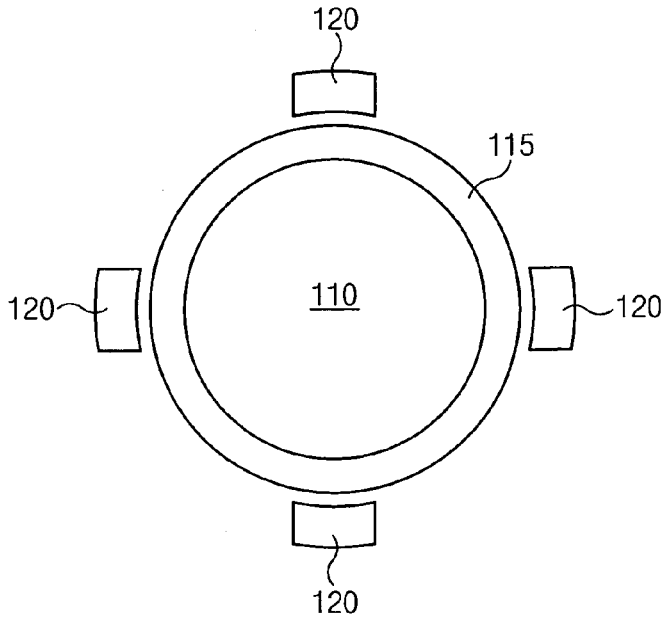
FIG. 2 illustrates a front view of a wafer transfer according to an exemplary embodiment of the present invention.

According to FIG. 1 and FIG. 2, a wafer transfer apparatus 100 of an exemplary embodiment of the present invention comprises a tray 110, a plurality of guides 120, a pusher 130, and a plurality of sensors 140 and 150.

A wafer 300 is mounted on the tray 110. There is a sloped portion 115 around the tray 110 on which the wafer 300 is mounted. The top surface of the sloped portion 115 is flat and inner side of the sloped portion 115 is tapered from the vertical to allow the wafer 300 to be centered when the wafer 300 is mounted.

A plurality of guides 120, for example four guides 120 depicted in FIG. 2, are disposed around the tray 110 at spaced intervals. The guides 120 direct the position and path of the wafer 300 when the wafer 300 is unloaded from the tray 110 and transferred to a holder such as a top ring, or when wafer 300 is loaded from a top ring to the tray 110. It is preferably that sides of the guides 120 that face the center of the tray 110 are tapered to mount the wafer 300 on the tray 110 more easily.

The pusher 130 moves the tray 110 up and down when the wafer 300 mounted on the tray 110 is transferred to another apparatus, or when a new wafer is transferred to the tray 110.

Assuming that a wafer is the object to be polished, it is unloaded by a robot from the carrier or FOUP, and is mounted on the tray 110. To polish the wafer 300 mounted on the tray 110, the wafer 300 should be transferred to the polishing part including a polishing table (not shown) to which a polishing pad is attached, and a wafer holding part 200 is employed to hold the wafer like a top ring. The wafer holding part 200 is positioned over the wafer transfer 100, and the tray 110 is moved to the wafer holding part 200 by means of the pusher 130. The wafer 300 is held by vacuum on the wafer holding part 200 from the tray 110. The wafer holding part 200 transfers the wafer to a position over the polishing table. Then, the wafer holding part 200 presses and rotates the wafer against the moving polishing pad. In this way, the wafer is polished.

The polished wafer is moved to the wafer transfer apparatus 100 by operation of the wafer holding part 200. The tray 110 is moved to the wafer holding part 200 by the pusher 130, and the wafer is mounted on the tray 110 from the wafer holding part 200.

A plurality of sensors, for example, sensors 140 and 150, detect whether the wafer 300 is loaded exactly and properly on the tray 110. Each of the sensors 140 and 150 detects the sidewall of the wafer 300 on the tray 110. It may be desirable that more than sensors 140 and 150 are installed around the tray 110 for the purpose of more precisely sensing the position of the wafer 300.

It is preferable that the sensors 140 and 150 are located at the same level as the sidewall of the wafer 300 in order to effectively sense the sidewall of the wafer 300. For purposes of convenience, in FIG. 1, the sensor 140 on the left is designated as first sensor 140, and the sensor 150 on the right is designated as second sensor 150.

The first sensor 140 may comprise a light-emitting element 140*a* and a light-receiving element 140*b*. The light-emitting element 140*a* may comprise a light emitting diode, and the light-receiving element 140*b* may comprise a photo diode. In addition, the light-emitting element 140*a* may use a laser. Light emitted from the light-emitting element 140*a* is indicated as a solid line arrow, and light passing into the light-receiving element 140*b* is indicated as a dotted line arrow.

In the respective light-emitting and light-receiving elements 140*a* and 140*b*, for example, the light-emitting element 140*a* may be disposed above the light-receiving element 140*b* in the direction of the thickness of the wafer 300. As depicted in the following FIG. 3, the light-emitting element 140*a* may be located adjacent to light-emitting element 140*b* laterally in the direction of diameter of the wafer 300.

In another configuration, the light-emitting and light-receiving elements 140*a* and 140*b* of the first sensor 140 are formed in a unitary construction. Similarly to the first sensor 140, a light-emitting element 150*a* and a light-receiving element 150*b* of the second sensor 150 are respectively stacked above and below with respect to each other, or are arranged in a lateral position with respect to each other.

Figure 3:
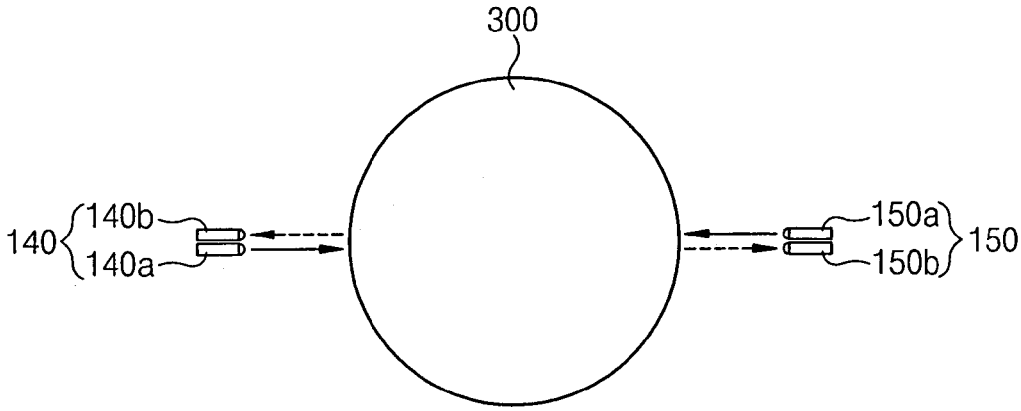
FIG. 3 illustrates a top view of the disposition of sensors in a wafer transfer of FIG. 1 according to an exemplary embodiment of the present invention.

According to FIG. 3, the first sensor 140 and the second sensor 150 face each other across the body of wafer 300 as depicted in the FIG. 1. The light-emitting element 140*a* and the light-receiving element 140*b* of the first sensor 140 are disposed laterally. Similarly, the light-emitting element 150*a* and the light-receiving element 150*b* are disposed laterally. This lateral disposition of the sensors 140 and 150 has an advantage with respect to sensing the horizontality of the wafer 300.

This relative position of the sensors 140 and 150 can be employed to detect the horizontality of the wafer 300. This is the case even though the wafer 300 is tilted to one side on its axis which links sensors 140 and 150 via the center of the wafer 300.

Figure 4:
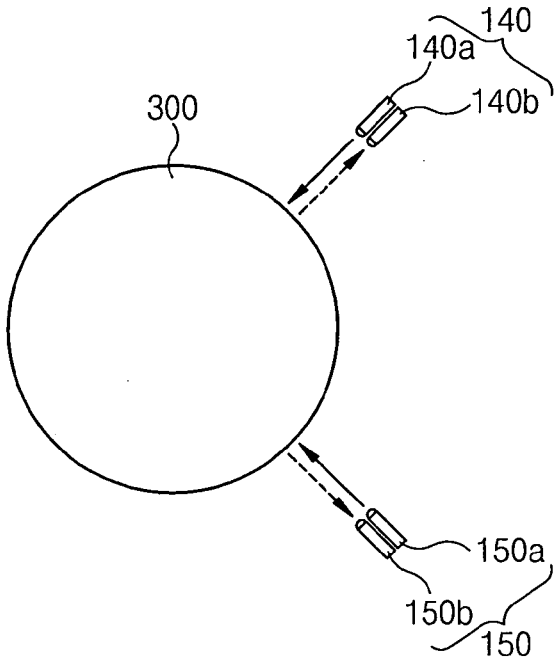
FIG. 4 illustrates a top view of the disposition of sensors in a wafer transfer of FIG. 1 according to an alternate exemplary embodiment of the present invention.

As illustrated in FIG. 4, it is desirable that sensors 140 and 150 are positioned not to face each other across the body of the wafer 300. Compared with the arrangement of sensors 140 and 150 in FIG. 3, the position of sensors 140 and 150 in FIG. 4 can more accurately detect the horizontality of the wafer 300.

Figure 5:
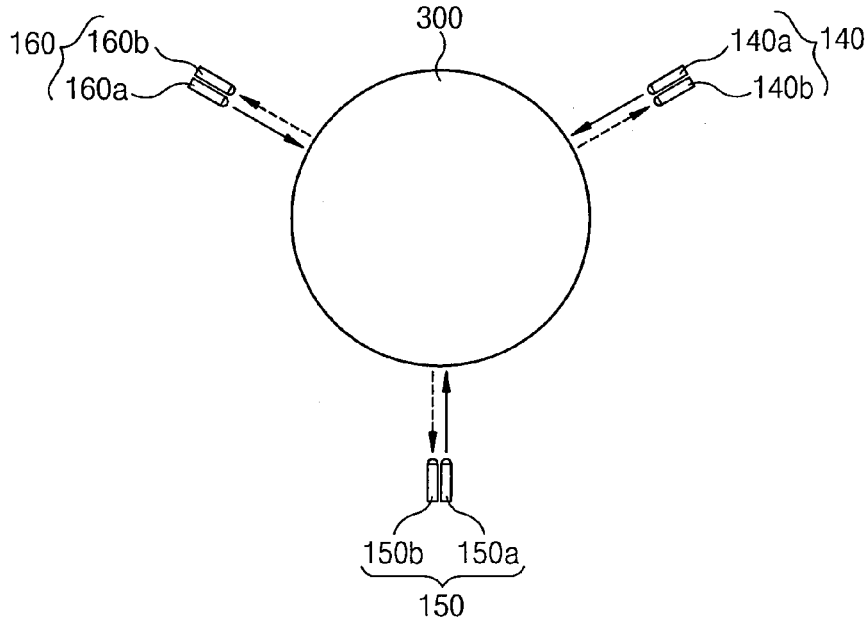
FIG. 5 illustrates a top view of the disposition of sensors in a wafer transfer of FIG. 1 according to another alternate exemplary embodiment of the present invention.

According to FIG. 5, three sensors 140 and 150 and 160, respectively, may be arranged around the wafer 300. It is preferable that these three sensors 140 and 150 and 160 be spaced around the wafer 300 at regular intervals in the circumferential direction to detect more accurately detect the horizontality of the wafer 300.

Figure 6:
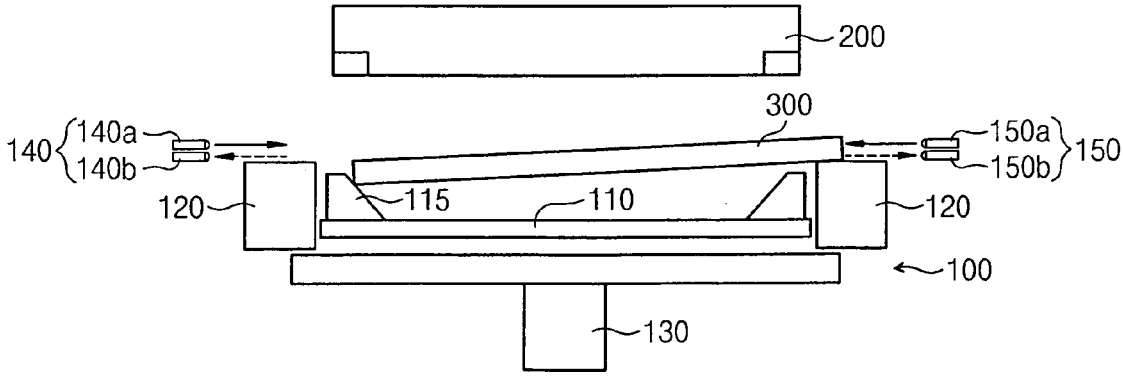
FIG. 6 illustrates a cross-sectional view of sensing operation of sensors in a wafer transfer of FIG. 1 according to an exemplary embodiment of the present invention.

The operation of the wafer transfer apparatus 100 is as follows:

Referring to FIG. 6, when the wafer that is polished in the polishing process is unloaded from the wafer holding part 200, such like a top ring, the tray 110 is moved into the wafer holding part 200 by operation of the pusher 130. The re-positioned tray 110 receives the wafer 300 from the wafer holding part 200. The unloaded wafer 300 is then mounted on the inclined part 115 of the tray 110. The wafer 300 may be unloaded from the wafer holding part 200 after predetermined time so that the wafer 300 is not properly mounted on the tray 110. Especially, the wafer 300 is so tilted that one side of the wafer 300 is on the guide 120.

When the wafer 300 is unloaded from the wafer holding part 200, and is mounted on the tray 110 of the wafer transfer 100, the sensors 140 and 150 detect the sidewalls of the wafer 300. The light-emitting element 140*a* of the first sensor 140 emits a specific wavelength of light into the sidewall of the wafer 300, and the light-receiving element 140*b* of the first sensor 140 receives the light emitted from the light-emitting element 140*a*. If the light-receiving element 140*b* accepts the light emitted from the light-emitting element 140*a*, it indicates that the wafer 300 is mounted on the tray 110 in a proper position. If the light-receiving element 140*b* does not accept the light emitted from the light-emitting element 140*a*, it indicates that the wafer 300 is not mounted on the tray 110 in a proper position. The function of the second sensor 150 is the same as that of the first sensor 140. Any additional sensors, if any, function in the same manner.

If the wafer 300 is not properly mounted on the guide 120, the light-receiving element 140*a* of the first sensor 140 cannot accept the light emitted from the light-emitting element 150*b*. Similarly, if the wafer 300 is not properly loaded on the guide 120, the light-receiving element 140*a* of the first sensor 140 cannot accept the light emitted from the light-emitting element 150*b*. Thus, in either case, the apparatus 100 has indicated that the wafer 300 has not been mounting on the guide 120.

If either of the sensors 140 and 150 does not detect proper positioning of wafer 300, the process does not advance to the next step. Stated in any way, the wafer 300 will advance to the next process step if all sensors 140 and 150 detect that proper positioning of wafer 300.

It is preferable that an alarm means (not shown) for aurally or visually informing a user as to the state of the wafer 300, which functions in conjunction with a signal from the sensors 140 and 150, can be included in the wafer transfer apparatus 100. Examples of the alarm means may include a bell for sounding an auditory signal or a lamp for illuminating a light to inform a user of the substandard condition of the wafer. This alarm means will enable workers to quickly stop the wafer transfer process, or allow the wafer transfer to be stopped automatically.

Figure 7:
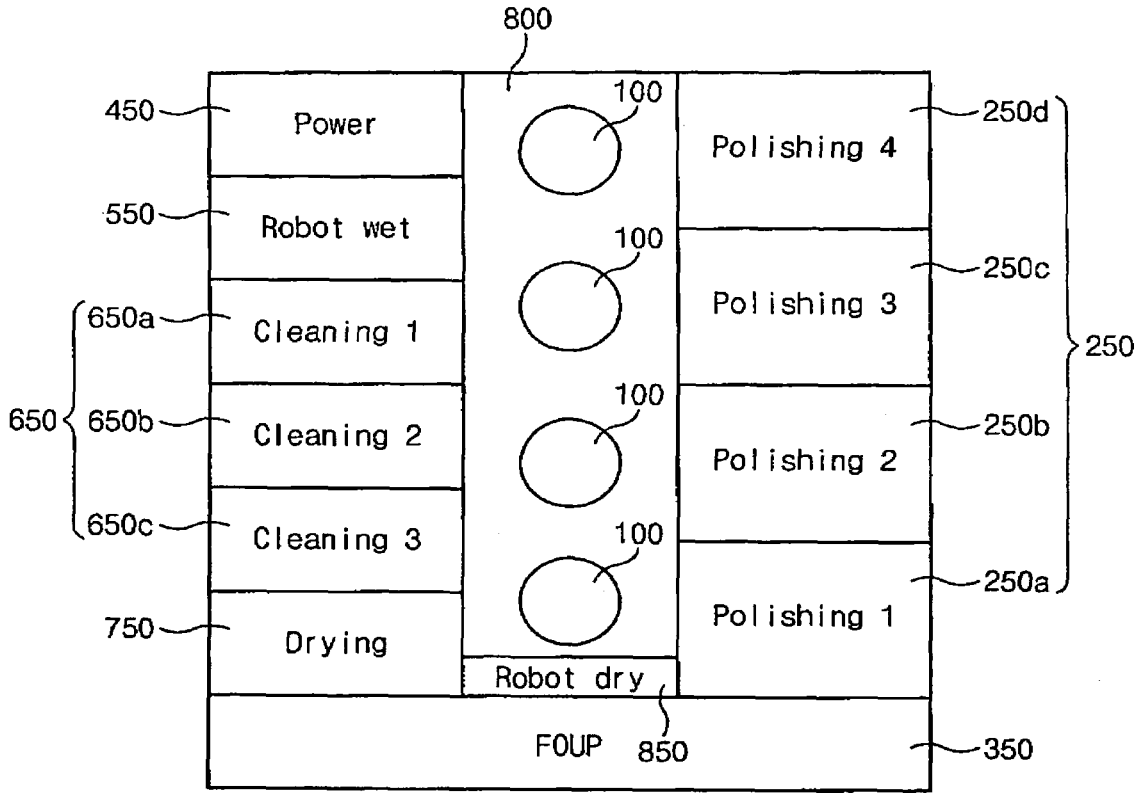
FIG. 7 illustrates a top view of an apparatus for polishing a wafer comprising a wafer transfer of FIG. 1 according to an exemplary embodiment of the present invention.

Referring to FIG. 7, a polishing apparatus used in conjunction with the wafer transfer apparatus 100 according to an exemplary embodiment of the present invention comprises a power station 450 to provide the energy to operate the apparatus 100, a wafer stocking assembly 350 for stocking a plurality of wafers, a polishing assembly 250 for performing the polishing process, a rinsing assembly 650 for rinsing the wafers polished, a drying assembly 750 for drying the wafers rinsed, robots 550 and 850 for transferring the wafers, and a space for providing the wafer transfer apparatus 100 with a moving road.

The wafer stocking assembly 350 has a plurality of tools to load the wafers, e.g. FOUP, so that the robot 850 (referred to as a robot dry or a first robot) takes out the wafers loaded on some FOUP in the wafer stocking part 350.

The wafer that is removed from the wafer stocking assembly 350 is loaded on the wafer transfer apparatus 100. The wafer loaded on the wafer transfer apparatus 100 is then transferred to the polishing assembly 250.

The polishing assembly 250 may comprise a plurality of chambers, for example, a first chamber 250*a*, a second chamber 250*b*, a third chamber 250*c*, and a fourth chamber 250*d*. Each of the chambers 250*a*–250*d* comprises at least a wafer holding assembly like a top ring, and a polishing table to which a polishing pad is attached. The wafer is attached to a bottom surface of the wafer holding assembly. The wafer that attached to the bottom surface of the wafer holding assembly is pressed down against the polishing table and then the wafer is polished.

The wafer 300 is transferred to the first chamber 250*a* via the wafer transfer apparatus 100 and then the wafer 300 is polished in the first chamber 250*a*.

The wafer loading from the wafer transfer apparatus 100 to the first chamber 250*a* has been previously described. The wafer that is polished in the first chamber 250*a* is transported from the first chamber 250*a* to the wafer transfer apparatus 100. As previously mentioned above, a plurality of sensors 140 and 150 detect the sidewalls of the wafer 300 mounted on the tray 110 and then confirm the horizontality of the wafer 300. When the result of the sensing the wafer 300 are deemed acceptable, the wafer 300 is advanced to the next processing step. When the result of the sensing the wafer 300 are not deemed acceptable, correction of any problems in the process sequence will typically need to be implemented prior to proceeding with the process.

The wafer transfer apparatus 100 mounting the wafer 300 unloaded from the first chamber 250*a* moves to the second chamber 250*b* along the moving space 800. The wafer transfer apparatus 100 positioned near the second chamber 250*b* transfers the wafer 300 to the second chamber 250*b*. The wafer 300 transferred to the second chamber 250*b* is polished again and then returns to the wafer transfer 100. If the wafer 300 is returned to the wafer transfer 100, the wafer 300 is repeatedly sensed by the sensors 140 and 150. Similarly, the wafer transfer apparatus 100 mounting the wafer 300 unloaded from the second chamber 250*b* moves to the third chamber 250*c* along the moving space 800. The wafer transfer apparatus 100 positioned near the third chamber 250*c* transfers the wafer 300 to the third chamber 250*c*. The wafer 300 transferred to the third chamber 250*c* is polished again and then is returned to the wafer transfer 100. When the wafer 300 is returned to the wafer transfer 100, the wafer 300 is repeatedly sensed by the sensors 140 and 150. Likewise, the wafer transfer apparatus 100 mounting the wafer 300 unloaded from the third chamber 250*c* moves to the fourth chamber 250*d* along the moving space 800. The wafer transfer apparatus 100 positioned by the fourth chamber 250*d* transfers the wafer 300 to the fourth chamber 250*d*. The wafer 300 transferred to the fourth chamber 250*d* is polished again and then is returned to the wafer transfer 100. In returning the wafer 300 to the wafer transfer 100, the wafer 300 is repeatedly sensed by the sensors 140 and 150.

The wafer 300 which is polished and loaded on the wafer transfer apparatus 100 and then into the rinsing apparatus 650 by means of the robot 550 (referred to as a robot wet or a second robot). The rinsing apparatus 650 may comprise a first chamber 650*a*, a second chamber 650*b*, and a third chamber 650*c*. The wafer 300 loaded in the rinsing apparatus 650 via the second robot 550 is cleaned using washing solutions while the wafer 300 is traveling through the chambers 650*a*–650*c*. The wafer 300 cleaned in the rinsing apparatus 650 is then moved to the drying apparatus 750 so that washing solution remaining on the surface of the wafer 300 is dried.

As described above, sensors detect the location of the sidewalls of the wafer 300 mounted on the tray 110 so that the presence of a normal wafer mounting position can be determined. Therefore, many problems relating to wafer mis-positioning can be avoided, thereby improving the throughput and/or yield associated with wafer production.

Although the present invention has been described in connection with the embodiment of the present invention illustrated in the accompanying drawings, it is not limited thereto. It will be apparent to those skilled in the art that various substitution, modifications and changes may be thereto without departing from the scope and spirit of the invention.

What is claimed is:

1. An apparatus for transporting a wafer comprising:

a tray having a sloped portion on which a wafer having a sidewall can be mounted;

a plurality of guides disposed about the tray; and a plurality of sensors for detecting a proper mounting position of the wafer with respect to the tray by sensing the position of the wafer sidewall.

2. The apparatus of claim 1, wherein all of the plurality of sensors are disposed at predetermined spaced intervals.

3. The apparatus of claim 1, wherein the plurality of sensors are spaced apart circumferentially about the wafer when it is mounted on the tray.

4. The apparatus of claim 1, wherein at least two sensors face each other and are located on opposite sides of the wafer when it is mounted on the tray.

5. The apparatus of claim 1, wherein each of the plurality of sensors comprises a light-emitting element and a light-receiving element.

6. The apparatus of claim 5, wherein the light-emitting and light-receiving elements comprise a unitary construction.

7. The apparatus of claim 5, wherein the light-emitting and light-receiving elements comprise a non-unitary construction.

8. The apparatus of claim 5, wherein the light-emitting and light receiving elements are disposed in a direction normal to the sidewall of the wafer when it is mounted on the tray.

9. The apparatus of claim 5, wherein at least one pair of the light-emitting and light-receiving elements are disposed in a direction normal to the sidewall of a wafer mounted on the tray, and facing each other and are located on opposite sides of the wafer when it is mounted on the tray.

10. The apparatus of claim 5, wherein each pair of the light-emitting and light-receiving elements are disposed in a direction normal to the sidewall of a wafer mounted on the tray, and at least a portion of the light-emitting and light-receiving elements are not facing each other and are located on opposite sides of the wafer when it is mounted on the tray.

11. An apparatus for polishing a wafer comprising:

a polishing apparatus having a holder for holding a wafer; and a wafer transfer apparatus comprising a tray having a slope portion on which a wafer having a sidewall can be mounted, a plurality of guides disposed around the tray, a pusher for moving the tray and the plurality of guides in an upward direction and a downward direction, and a plurality of sensors for detecting a proper mounting position of the wafer with respect to the tray by emitting a signal directed at the wafer sidewall and receiving the emitted signal from the sidewall when the wafer is in the proper mounting position.

12. The apparatus of claim 11, wherein the plurality of sensors are disposed at predetermined spaced intervals.

13. The apparatus of claim 11, wherein the plurality of sensors are spaced apart about the wafer when it is mounted on the tray.

14. The apparatus of claim 11, wherein at least two sensors face each other and are located on opposite sides of the wafer when it is mounted on the tray.

15. The apparatus of claim 11, wherein each of the plurality of sensors comprises a light-emitting element and a light-receiving element.

16. The apparatus of claim 15, wherein the light-emitting and light-receiving elements comprise a unitary construction.

17. The apparatus of claim 15, wherein the light-emitting and light-receiving elements are divided into two bodies.

18. The apparatus of claim 15, wherein the light-emitting and light-receiving elements are disposed in a direction normal to the sidewall of the wafer when it is mounted on the tray.

19. The apparatus of claim 11, which further comprises:

a first robot for transferring the wafer to the wafer transfer apparatus;

a wafer rinsing apparatus for rinsing a wafer; and a second robot for transferring a wafer from the wafer transfer apparatus to the wafer rinsing apparatus.

20. The apparatus of claim 19, which further comprises:

a wafer drying apparatus for drying of the wafer.

* * * * *